US011421167B2

(12) United States Patent
Mukherjee et al.

(10) Patent No.: US 11,421,167 B2
(45) Date of Patent: Aug. 23, 2022

(54) INTEGRATED PYROLYSIS AND HYDROCRACKING UNITS FOR CRUDE OIL TO CHEMICALS

(71) Applicant: LUMMUS TECHNOLOGY LLC, Bloomfield, NJ (US)

(72) Inventors: Ujjal K. Mukherjee, Montclair, NJ (US); Kandasamy Meenakshi Sundaram, Old Bridge, NJ (US); Ronald M. Venner, Franklin Lakes, NJ (US); Stephen J. Stanley, Matawan, NJ (US)

(73) Assignee: LUMMUS TECHNOLOGY LLC, Houston, TX (US)

( * ) Notice: Subject to any disclaimer, the term of this patent is extended or adjusted under 35 U.S.C. 154(b) by 18 days.

(21) Appl. No.: 17/039,767

(22) Filed: Sep. 30, 2020

(65) Prior Publication Data

US 2021/0017462 A1 Jan. 21, 2021

Related U.S. Application Data

(60) Division of application No. 16/039,167, filed on Jul. 18, 2018, now Pat. No. 10,793,793, which is a continuation of application No. 62/534,095, filed on Jul. 18, 2017.

(51) Int. Cl.
*C10G 69/06* (2006.01)
*C10G 69/14* (2006.01)

(52) U.S. Cl.
CPC ..... *C10G 69/06* (2013.01); *C10G 2400/20* (2013.01); *C10G 2400/22* (2013.01)

(58) Field of Classification Search
CPC .... C10G 69/06; C10G 69/14; C10G 2400/20; C10G 2400/22; C10G 9/14; C10G 9/36; C10G 47/02
See application file for complete search history.

(56) References Cited

U.S. PATENT DOCUMENTS

2009/0050523 A1* 2/2009 Halsey ..... C10G 9/00 208/68
2012/0125812 A1 5/2012 Bridges et al.
2013/0066122 A1 3/2013 Joseck et al.
(Continued)

FOREIGN PATENT DOCUMENTS

CN 103210062 A 7/2013
WO 2015000845 A1 1/2015

OTHER PUBLICATIONS

Sundaram ("Thermodynamic Model of Sediment Deposition in the LC-FINING Process" Energy & Fuels 2008, 22, 3226-3236) (Year: 2008).*

(Continued)

*Primary Examiner* — In Suk C Bullock
*Assistant Examiner* — Jason Y Chong
(74) *Attorney, Agent, or Firm* — Osha Bergman Watanabe & Burton LLP

(57) ABSTRACT

Integrated pyrolysis and hydrocracking systems and processes for efficiently cracking of hydrocarbon mixtures, such as mixtures including compounds having a normal boiling temperature of greater than 450° C., 500° C., or even greater than 550° C., such as whole crudes for example, are disclosed.

21 Claims, 7 Drawing Sheets

(56) References Cited

U.S. PATENT DOCUMENTS

2016/0097002 A1 4/2016 Sundaram

OTHER PUBLICATIONS

Extended European Search Report issued in European Application No. 18835941.8, dated Nov. 20, 2020 (10 pages).
Office Action issued in Chinese Application No. 201880040681.0, dated Mar. 24, 2021 (35 pages).
Notice of Reasons for Refusal issued in Application No. 2019-558430, dated Feb. 16, 2021 (11 pages).
Sinnott ("2.14 Recycle Processes." Chemical Engineering Design, Fourth ed. vol. 6. 2005, 50) (Year: 2005) (3 pages).
Office Action issued in corresponding U.S. Appl. No. 17/060,568 dated Sep. 23, 2021 (31 pages).

* cited by examiner

INTEGRATED PYROLYSIS AND HYDROCRACKING UNITS FOR CRUDE OIL TO CHEMICALS

FIELD OF THE DISCLOSURE

Embodiments disclosed herein relate generally to the integrated pyrolysis and hydrocracking of hydrocarbon mixtures, such as whole crudes or other hydrocarbon mixtures, to produce olefins and other chemicals.

BACKGROUND

Hydrocarbon mixtures having an end boiling point over 550° C. are generally not processed directly in a pyrolysis reactor to produce olefins, as the reactor cokes fairly rapidly. While limiting reaction conditions may reduce the fouling tendency, the less severe conditions result in a significant loss in yield.

The general consensus in the art is that hydrocarbon mixtures having a wide boiling range and/or hydrocarbons having a high end boiling point require an initial separation of the hydrocarbons into numerous fractions, such as gas/light hydrocarbons, naphtha range hydrocarbons, gas oil, etc., and then cracking each fraction under conditions specific for those fractions, such as in separate cracking furnaces. While the fractionation, such as via a distillation column, and separate processing may be capital and energy intensive, it is generally believed that the separate and individual processing of the fractions provides the highest benefit with respect to process control and yield.

To date, most crude has been partially converted to chemicals in large refinery-petrochemicals complexes. The focus of the refinery is to produce transportation fuels such as gasoline and diesel. Low value streams from the refinery, such as LPG and light naphtha, are routed to petrochemicals complexes that may or may not be adjacent to the refinery. The petrochemicals complex then produces chemicals such benzene, para-xylene, ethylene, propylene and butadiene. A typical complex of this kind is shown in FIG. 1.

In the conventional method crude oil is desalted and preheated and sent to a crude oil distillation column. There, various cuts comprising, naphtha, kerosene, diesel, gasoil, vacuum gasoil and residue are produced. Some cuts, like naphtha and gas oils, are used as feed to produce olefins. VGO and residue are hydrocracked to produce fuels. The products obtained from the crude tower (atmospheric distillation) and from the vacuum tower are used as fuel (gasoline, jet fuel, diesel, etc.) Generally, they do not meet fuel specifications. Therefore, isomerization, reforming, and/or hydroprocessing (hydrodesulfurization, hydrodenitrogenation, and hydrocracking) are done to these products before use as a fuel. Olefin plants may receive feeds before refining and/or after refining, depending upon the refinery.

SUMMARY OF THE DISCLOSURE

Integrated pyrolysis and hydrocracking processes have now been developed for flexibly processing whole crudes and other hydrocarbon mixtures containing high boiling coke precursors. Embodiments herein may advantageously reduce coking and fouling during the pyrolysis process, even at high severity conditions, effectively and efficiently integrating hydrocracking of the heavier portions of whole crudes, attaining olefin yields comparable to naphtha crackers, while significantly decreasing the capital and energy requirements associated with pre-fractionation and separate processing normally associated with whole crude processing.

In one aspect, embodiments disclosed herein relate to an integrated pyrolysis and hydrocracking process for converting a hydrocarbon mixture to produce olefins. The process may include mixing a whole crude and a gas oil to form a hydrocarbon mixture. The hydrocarbon mixture may then be heated in a heater to vaporize a portion of the hydrocarbons in the hydrocarbon mixture and form a heated hydrocarbon mixture. The heated hydrocarbon mixture may then be separated, in a first separator, into a first vapor fraction and a first liquid fraction. The first vapor fraction, optionally mixed with steam, and the resulting mixture may be superheated in the convection zone and fed to a first radiant coil in a radiant zone of the pyrolysis reactor. The first liquid fraction, or a portion thereof, may be fed along with hydrogen to a hydrocracking reactor system, for contacting the first liquid fraction with a hydrocracking catalyst to crack a portion of the hydrocarbons in the first liquid fraction. An effluent recovered from the hydrocracking reactor system may be separated to recover unreacted hydrogen from the hydrocarbons in the effluent, and the effluent hydrocarbons may be fractionated to form two or more hydrocarbon fractions including the gas oil fraction.

In another aspect, embodiments disclosed herein relate to an integrated pyrolysis and hydrocracking process for converting a hydrocarbon mixture to produce olefins. The process may include mixing a whole crude and a gas oil to form a hydrocarbon mixture. The hydrocarbon mixture may be heated in a heater to vaporize a portion of the hydrocarbons in the hydrocarbon mixture and to form a heated hydrocarbon mixture. The heated hydrocarbon mixture may be separated, in a first separator, into a first vapor fraction and a first liquid fraction. The first liquid fraction may then be heated in a convection zone of a pyrolysis reactor to vaporize a portion of the hydrocarbons in the first liquid fraction and form a second heated hydrocarbon mixture. The second heated hydrocarbon mixture may then be separated, in a second separator, into a second vapor fraction and a second liquid fraction. Steam may be mixed with the first vapor fraction, the process including superheating the resulting mixture in the convection zone, and feeding the superheated mixture to a first radiant coil in a radiant zone of the pyrolysis reactor. Steam may also be mixed with the second vapor fraction, the process including superheating the resulting mixture in the convection zone, and feeding the superheated mixture to a second radiant coil in a radiant zone of the pyrolysis reactor. The second liquid fraction, or a portion thereof, may be fed along with hydrogen to a hydrocracking reactor system for contacting of the second liquid fraction with a hydrocracking catalyst to crack a portion of the hydrocarbons in the second liquid fraction, and for recovering an effluent from the hydrocracking reactor system. Unreacted hydrogen may be separated from the hydrocarbons in the effluent, which may be fractionated to form two or more hydrocarbon fractions including the gas oil fraction and a residue fraction.

In another aspect, embodiments disclosed herein relate to a system including apparatus for performing the above described processes.

In some embodiments, for example, a system for producing olefins and/or dienes according to embodiments herein may include a pyrolysis heater having a convection heating zone and a radiant heating zone. A heating coil in the convection heating zone may be provided for partially vaporizing a whole crude to form a liquid fraction and a vapor fraction. A second heating coil in the convection heating zone may be provided for superheating the vapor fraction. Further, a radiant heating coil may be disposed in the radiant heating zone for thermally cracking the superheated vapor fraction to produce a cracked hydrocarbon effluent containing a mixture of olefins and paraffins. A hydrocracking reaction zone may be used for hydrocracking at least a portion of the liquid fraction to produce a hydrocracked hydrocarbon effluent containing additional olefins and/or dienes. Flow conduits, valves, controls, pumps, and other equipment may be included in the system to provide the desired connections and flows noted above.

Systems herein may include a separator for separating the hydrocracked hydrocarbon effluent to recover two or more hydrocarbon fractions including a gas oil fraction. Systems herein may also include means for mixing the gas oil fraction with the whole crude upstream of the heating coil. Means for mixing steam with the vapor fraction upstream of the second heating coil may also be provided. Means for mixing may include, for example, piping tees or connections, pumps, static mixers, and the like, among other means for mixing known in the art.

Systems herein may also include, for example, a third heating coil in the convection heating zone for partially vaporizing the liquid fraction to form a second liquid fraction and a second vapor fraction, and/or a fourth heating coil in the convection heating zone for superheating the second vapor fraction. A second radiant heating coil in the radiant heating zone may be used for thermally cracking the superheated vapor fraction to produce a second cracked hydrocarbon effluent containing a mixture of olefins and paraffins. A flow line may be provided for feeding the second liquid fraction to the hydrocracking step as the at least a portion of the liquid fraction.

Systems herein may also include means for mixing steam with various hydrocarbon containing streams. For example, systems herein may include means for mixing steam with and separating the partially vaporized whole crude to form the liquid fraction and the vapor fraction, and/or means for mixing steam with and separating the partially vaporized liquid fraction to form the second liquid fraction and the second vapor fraction.

In embodiments in this disclosure, the whole crude may be sent to a pyrolysis unit after desalting. In the convection section, light material may be vaporized in the presence of steam and reacted in the radiant section. The heavies are sent to hydrocracker. Products from the hydrocracker may be sold as fuel and/or processed in the pyrolysis unit to make additional chemicals. Heavy products from the pyrolysis unit (olefins unit), such as pyrolysis gasoil and fuel oil, may be sent to a hydrocracker for upgrading along with fresh feed from crude. Feeds and products are exchanged between the integrated pyrolysis and cracking units to produce a maximum amount of chemicals and/or fuels as required. Only a small portion is discarded as tar.

Embodiments herein do not require a crude separation unit. Therefore, it reduces the cost and energy associated with that unit. One or more hydrocrackers operating at different conditions can be used to optimize chemicals/fuels production. The bleed/tar in the hydrocracker is a very heavy high boiling material and may be sold as product to maximize catalyst life. As the hydrocracker is designed to process residue, pyrolysis gasoil and fuel oil produced in the cracker and/or the pyrolysis unit may be used as feed in the hydrocracker. This maximizes valuable chemicals in the overall plant. Light material, like LPG and naphtha produced in the hydrocracker, may be used as feeds in the olefin plant. Unconverted oil may also be used as feed to the thermal cracker.

Integrated pyrolysis and hydrocracking process disclosed herein offer high yields of desired olefins, dienes, diolefins and aromatics. At the same time, valuable jet and kerosene fuels may also be produced when required. There is no need to install a separate crude separation unit. Each cut can be optimally cracked using embodiments herein. Fuel oil produced in the pyrolysis unit can also be hydrocracked to produce more feeds to the olefins plant. Light feeds produced in the hydrocracker may also be thermally cracked to produce more olefins.

The process flow diagrams shown in the attached sketches can be slightly modified for specific crudes and product slates. Other aspects and advantages will be apparent from the following description and the appended claims.

DETAILED DESCRIPTION

Figure 1:
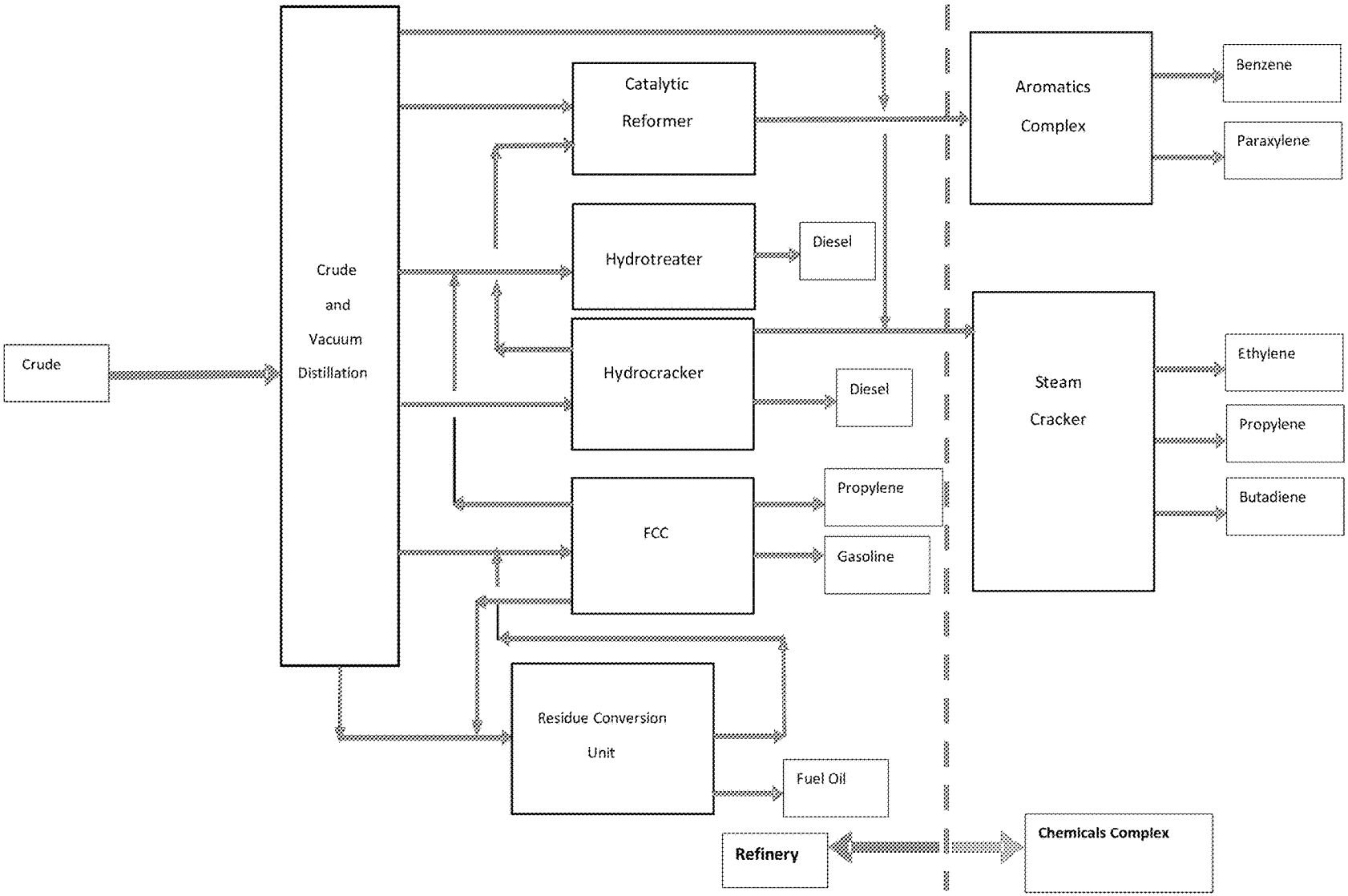
FIG. 1 is a simplified process flow diagram of a typical refinery-petrochemicals complex.

Embodiments disclosed herein relate generally to the pyrolysis and hydrocracking of hydrocarbon mixtures, such as whole crudes or other hydrocarbon mixtures, to produce olefins. More specifically, embodiments disclosed herein relate to the efficient separation of hydrocarbon mixtures using heat recovered from a convective section of a heater in which the cracking is being performed.

Hydrocarbon mixtures useful in embodiments disclosed herein may include various hydrocarbon mixtures having a boiling point range, where the end boiling point of the mixture may be greater than 450° C. or greater than 500° C., such as greater than 525° C., 550° C., or 575° C. The amount of high boiling hydrocarbons, such as hydrocarbons boiling over 550° C., may be as little as 0.1 wt %, 1 wt % or 2 wt %, but can be as high as 10 wt %, 25 wt %, 50 wt % or greater. The description is explained with respect to crude, but any high boiling end point hydrocarbon mixture, such as crudes and condensates, can be used. The Examples below are described with respect to a Nigerian light crude for illustrative purposes, but the scope of the present application is not limited to such crudes. Processes disclosed herein can be applied to crudes, condensates and hydrocarbon with a wide boiling curve and end points higher than 500° C. Such hydrocarbon mixtures may include whole crudes, virgin crudes, hydroprocessed crudes, gas oils, vacuum gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, natural gas condensates, atmospheric pipestill bottoms, vacuum pipestill streams including bottoms, wide boiling range naphtha to gas oil condensates, heavy non-virgin hydrocarbon streams from refineries, vacuum gas oils, heavy gas oils, atmospheric residuum, hydrocracker wax, and Fischer-Tropsch wax, among others. In some embodiments, the hydrocarbon mixture may include hydrocarbons boiling from the naphtha range or lighter to the vacuum gas oil range or heavier. If desired, these feeds may be pre-processed to remove a portion of the sulfur, nitrogen, metals, and Conradson Carbon upstream of processes disclosed herein.

As noted above, when the end boiling point of the hydrocarbon mixture is high, such as over 550° C., such as including material boiling in the range from 480° C. to 560° C., for example above 520° C., which may be considered as residue, the hydrocarbon mixture cannot be processed directly in a pyrolysis reactor to produce olefins. The presence of these heavy hydrocarbons results in the formation of coke in the pyrolysis reactor system, where the coking may occur in one or more of the convection zone preheating coils or superheating coils, in the radiant coils, or in transfer line exchangers, and such coking may occur rapidly, such as in few hours. Whole crude is not cracked commercially, as it is not economical. It is generally fractionated, and only specific cuts are used in a pyrolysis heater to produce olefins. The remainder is used in other processes.

The thermal cracking reaction proceeds via a free radical mechanism. Hence, high ethylene yield can be achieved when it is cracked at high temperatures. Lighter feeds, like butanes and pentanes, require a high reactor temperature to obtain high olefin yields. Heavy feeds, like gas oil and vacuum gas oil (VGO), require lower temperatures. Crude contains a distribution of compounds from butanes to VGO and residue (material having a normal boiling point over 520° C., for example). Subjecting the whole crude without separation to high temperatures produces a high yield of coke (byproduct of cracking hydrocarbons at high severity) and plugs the reactor. The pyrolysis reactor has to be periodically shut down and the coke is cleaned by steam/air decoking. The time between two cleaning periods when the olefins are produced is called run length. When crude is cracked without separation, coke can deposit in the convection section coils (vaporizing the fluid), in the radiant section (where the olefin producing reactions occur) and/or in the transfer line exchanger (where the reactions are stopped quickly by cooling to preserve the olefin yields).

Embodiments disclosed herein use the convection section of a pyrolysis reactor (or a heater) to preheat and separate the feed hydrocarbon mixture into various fractions. Steam may be injected at appropriate locations to increase the vaporization of the hydrocarbon mixture and to control the heating and degree of separations. The vaporization of the hydrocarbons occurs at relatively low temperatures and/or adiabatically, so that coking in the convection section will be suppressed.

The convective section may thus be used to heat the entire hydrocarbon mixture, forming a vapor-liquid mixture. The vaporous hydrocarbons will then be separated from the liquid hydrocarbons, and only the vapors separated will be fed to radiant coils in one or more radiant cells of a single heater. The radiant coil geometry can be any type. An optimum residence coil may be chosen to maximize the olefins and the run length, for the feed hydrocarbon vapor mixture and reaction severity desired.

Multiple heating and separation steps may be used to separate the hydrocarbon mixture into two or more hydrocarbon fractions, if desired. This will permit cracking of each cut optimally, such that the throughput, steam to oil ratios, heater inlet and outlet temperatures and other variables may be controlled at a desirable level to achieve the desired reaction results, such as to a desired product profile while limited coking in the radiant coils and associated downstream equipment.

As various cuts, depending upon the boiling point of the hydrocarbons in the mixture, are separated and cracked, the coking in the radiant coils and transfer line exchangers can be controlled. As a result, the run length of the heater may be increased to many weeks, instead of few hours, with higher olefin production.

The remaining liquid may be hydroprocessed (hydrotreated and/or hydrocracked, for example). When the cut point is low, such as around 200° C., then the feed to the hydrocracker is high. When the end point is high, the feed to the hydrocracker is low for any crude. Regardless of the cut point selected, the entire liquid remaining can be sent to the hydrocracker. Alternatively, the liquid can be sent to the distillation column associated with hydroprocessing product separation. Here in this column, jet/kero (middle distillates) will be separated and only VGO+ material will be hydrocracked in a hydrocracker.

The VGO+ material can be further separated to VGO and residue. Any material boiling above 520° C. can be considered as residue. The cut point noted, 520° C., is exemplary, but can vary from 480° C. to 560° C., for example. With VGO/Residue separation, different hydrocrackers can be used for processing VGO and residue separately. Residue hydrocracking is more difficult than VGO. Depending upon the quality of crude and quantity of residue, the separation of the heavy liquid to VGO and residue may be economically attractive. If not economically attractive, all the liquids may be hydrocracked in the same hydrocracker.

The effluents from the hydrocracker may be separated in a distillation column as discussed above. Even with hydrocracking, recycling of the residue has to be considered carefully. To prevent excessive coking in the reactor, some residue purge is required. This bleed is a tar or pitch fraction. When 200° C.+ liquid material or 350° C.+ material obtained from vaporization system is sent to the hydrocracker directly, without going to the hydrocracker effluent distillation column, the severity of the hydrocracker can be adjusted accordingly, such as to mild severity or high severity cracking. At mild conditions, only high molecular weight species are hydrocracked, preserving most of light materials in the crude (middle distillates) and the effluents are sent to the product separation column. This produces a maximum amount of middle distillate fuels. In the high severity mode, light components, like LPG and naphtha cuts, will be increased. For all the cases herein, an optional hydrodesulfurization unit may be used before the hydrocracker. The products, such as LPG, naphtha, middle distillates, and unconverted oil boiling below the resid cut point (typically below 540° C.), may be sent to an olefin plant as feedstock. Middle distillates can be sold as product if desired. When all products are sent to an olefins plant, the chemicals product rate is increased. Only a small amount of tar, such as less than 5% of the whole crude feed, may be sent as tar. This may be considered maximum chemicals production mode. Depending upon the amount of middle distillate sold as product, the chemical production will decrease. The olefin complex produces hydrogen, methane, ethylene, ethane, propylene, propane, butadiene, butenes, butanes, C5-gasoline (C5-400° F.) and pyrolysis gas oil (PGO) and pyrolysis fuel oil (PFO>550° F.). Both PGO and PFO cuts are highly deficient in hydrogen and they are less desirable chemicals. Since a resid hydrocracker is used, all PGO and a certain portion of PFO (such as boiling points of less than 1000° F.) can be sent to resid hydrocracker. This maximizes the olefins produced in the olefin complex. With the resid hydrocracker, high molecular weight PGO and PFO will be hydrocracked and low molecular weight LPG and naphtha in addition to other liquid products may be used as a feed to an olefins complex. This maximizes the chemical production. All operations herein may be carried out without a crude tower. Some minor modifications to embodiments disclosed herein are possible for local situations to improve the process economy or required product.

As noted above, crude and/or heavy feeds with end points higher than 520° C. or 550° C. cannot currently be cracked successfully and economically without separating them, such as via upstream distillation or fractionation into multiple hydrocarbon fractions. In contrast, embodiments herein provide for limited or no use of fractionators to separate the various hydrocarbons for crude cracking. Embodiments herein may have a low capital cost and require less energy than processes requiring extensive fractionation. Further, embodiments herein convert a majority of the crude to produce a high yield of olefins via cracking.

By separating the hydrocarbon mixture into various boiling fractions, coking in each section can be controlled, by designing the equipment properly and controlling the operating conditions. In the presence of steam, the hydrocarbon mixture can be heated to high temperatures without coking in the convection section. Additional steam may be added to further vaporize the fluid adiabatically. Therefore, coking in the convection section is minimized. As different boiling cuts may be processed in independent coils, the severity for each cut can be controlled. This reduces the coking in the radiant coils and in the transfer line exchanger (TLE). Overall, olefin production may be maximized compared to a single cut with heavy tails (high boiling residue) removed. Heavy oil processing schemes or conventional preheating of whole crude without various boiling fractions produces less total olefins than embodiments disclosed herein. In processes disclosed herein, any material with a low boiling point to any end point can be processed at optimal conditions for that material. One, two, three or more individual cuts can be performed for crude and each cut can be processed separately at optimum conditions.

Saturated and/or superheated dilution steam may be added at appropriate locations to vaporize the feed to the extent desired at each stage. Crude separations of the hydrocarbon mixture are performed, such as via a flash drum or a separator having minimal theoretical stages, to separate the hydrocarbons into various cuts. Heavy tails may then be processed (update for present disclosure and hydrocracking and recycle)

The hydrocarbon mixture may be preheated with waste heat from process streams, including effluents from the cracking process or flue gas from the pyrolysis reactor/heater. Alternatively, crude heaters can be used for preheating. In such cases, to maximize thermal efficiency of the pyrolysis reactor, other cold fluids (like boiler feed water (BFW) or air preheat or economizer) can be employed as the uppermost cold sinks of the convection section.

The process of cracking hydrocarbons in a pyrolysis reactor may be divided into three parts, namely a convection section, a radiant section, and a quench section, such as in a transfer line exchanger (TLE). In the convection section, the feed is preheated, partially vaporized, and mixed with steam. In the radiant section, the feed is cracked (where the main cracking reaction takes place). In the TLE, the reacting fluid is quickly quenched to stop the reaction and control the product mixture. Instead of indirect quenching via heat exchange, direct quenching with oil is also acceptable.

Embodiments herein efficiently utilize the convection section to enhance the cracking process. All heating may be performed in a convection section of a single reactor in some embodiments. In other embodiments, separate heaters may be used for the respective fractions. In some embodiments, crude enters the top row of the convection bank and is preheated, with hot flue gas generated in the radiant section of the heater, at the operating pressure to medium temperatures without adding any steam. The outlet temperatures may be in the range from 150° C. to 400° C., depending upon the crude and throughput. At these conditions, 5% to 70% (volume) of the crude may be vaporized. For example, the outlet temperature of this first heating step may be such that naphtha (having a normal boiling point of up to about 200° C.) is vaporized. Other cut (end) points may also be used, such as 350° C. (gas oil), among others. Because the hydrocarbon mixture is preheated with hot flue gas generated in the radiant section of the heater, limited temperature variations and flexibility in the outlet temperature can be expected.

The preheated hydrocarbon mixture enters a flash drum for separation of the vaporized portion from the unvaporized portion. The vapors may go to further superheating, mixed with dilution steam, and then fed to the radiant coil for cracking. If sufficient material is not vaporized, superheated dilution steam can be added to the fluid in the drum. If sufficient material has vaporized, then cold (saturated or mildly superheated) steam can be added to the vapor. Superheated dilution steam can also be used instead of cold steam for a proper heat balance.

The vapor fraction, such as a naphtha cut, gas oil cut, or light hydrocarbon fraction, and dilution steam mixture is further superheated in the convection section and enters the radiant coil. The radiant coil can be in a different cell, or a group of radiant coils in a single cell can be used to crack the hydrocarbons in the vapor fraction. The amount of dilution steam can be controlled to minimize the total energy. Typically, the steam is controlled at a steam to oil ratio of about 0.5 w/w, where any value from 0.2 w/w to 1.0 w/w is acceptable, such as from about 0.3 w/w to about 0.7 w/w.

The liquid (not vaporized) in the flash drum may be mixed with small amounts of dilution steam and further heated in the convection section in a second convection zone coil, which may be in the same or a different heater. The S/O (steam to oil ratio) for this coil can be about 0.1 w/w, where any value from 0.05 w/w to 0.4 w/w may be acceptable. As this steam will also be heated along with crude, there is no need to inject superheated steam. Saturated steam is adequate. Superheated steam may be used in place of saturated steam, however. The superheated steam may also be fed to the second flash drum. This drum can be a simple vapor/liquid separating drum or more complex like a tower with internals. For most crude, the end boiling point is high and some material will never be vaporized at the outlet of this coil. Typical outlet temperatures may be in the range from about 300° C. to about 500° C., such as about 400° C. The outlet temperature may be chosen to minimize coking in this coil. The amount of steam added to the stream may be such that minimum dilution flow is used and maximum outlet temperature is obtained without coking. Since some steam is present, coking is suppressed. For high coking crudes, a higher steam flow is preferred.

Superheated steam may be added to the drum and will vaporize the hydrocarbon mixture further. The vapor is further superheated in the convection coil and enters the radiant coil. To avoid any condensation of vapors in the line, a small amount of superheated dilution steam can be added to the outlet of the drum (vapor side). This will avoid condensing of heavy material in the lines, which may eventually turn into coke. The drum can be designed to accommodate this feature also. In some embodiments, a heavy oil processing system ("HOPS") tower can be used, accounting for the condensing heavy materials.

The unvaporized liquid can be further processed or sent to fuel. If unvaporized liquid is further processed, the HOPS tower may preferentially be used. If a portion of the unvaporized liquid is sent to fuel, the unvaporized, hot, liquid may be exchanged with other cold fluids, such as the hydrocarbon feedstock or first liquid fraction, for example, maximizing energy recovery. Alternatively, the unvaporized liquid may be processed as described herein to produce additional olefins and higher value products. Additionally, heat energy available in this stream may be used to preheat other process streams or to generate steam.

The radiant coil technology can be any type with bulk residence times ranging from 90 milliseconds to 1000 milliseconds with multiple rows and multiple parallel passes and/or split coil arrangements. They can be vertical or horizontal. The coil material can be high strength alloys with bare and finned or internally heat transfer improved tubes. The heater can consist of one radiant box with multiple coils and/or two radiant boxes with multiple coils in each box. The radiant coil geometry and dimensions and the number of coils in each box can be the same or different. If cost is not a factor, multiple stream heaters/exchangers can be employed.

Following cracking in the radiant coils, one or more transfer line exchangers may be used to cool the products very quickly and generate (super) high pressure steam. One or more coils may be combined and connected to each exchanger. The exchanger(s) can be double pipe or multiple shell and tube exchanger(s).

Instead of indirect cooling, direct quenching can also be used. For such cases, oil may be injected at the outlet of the radiant coil. Following the oil quench, a water quench can also be used. Instead of oil quench, an all water quench is also acceptable. After quenching, the products are sent to a recovery section.

Figure 2:
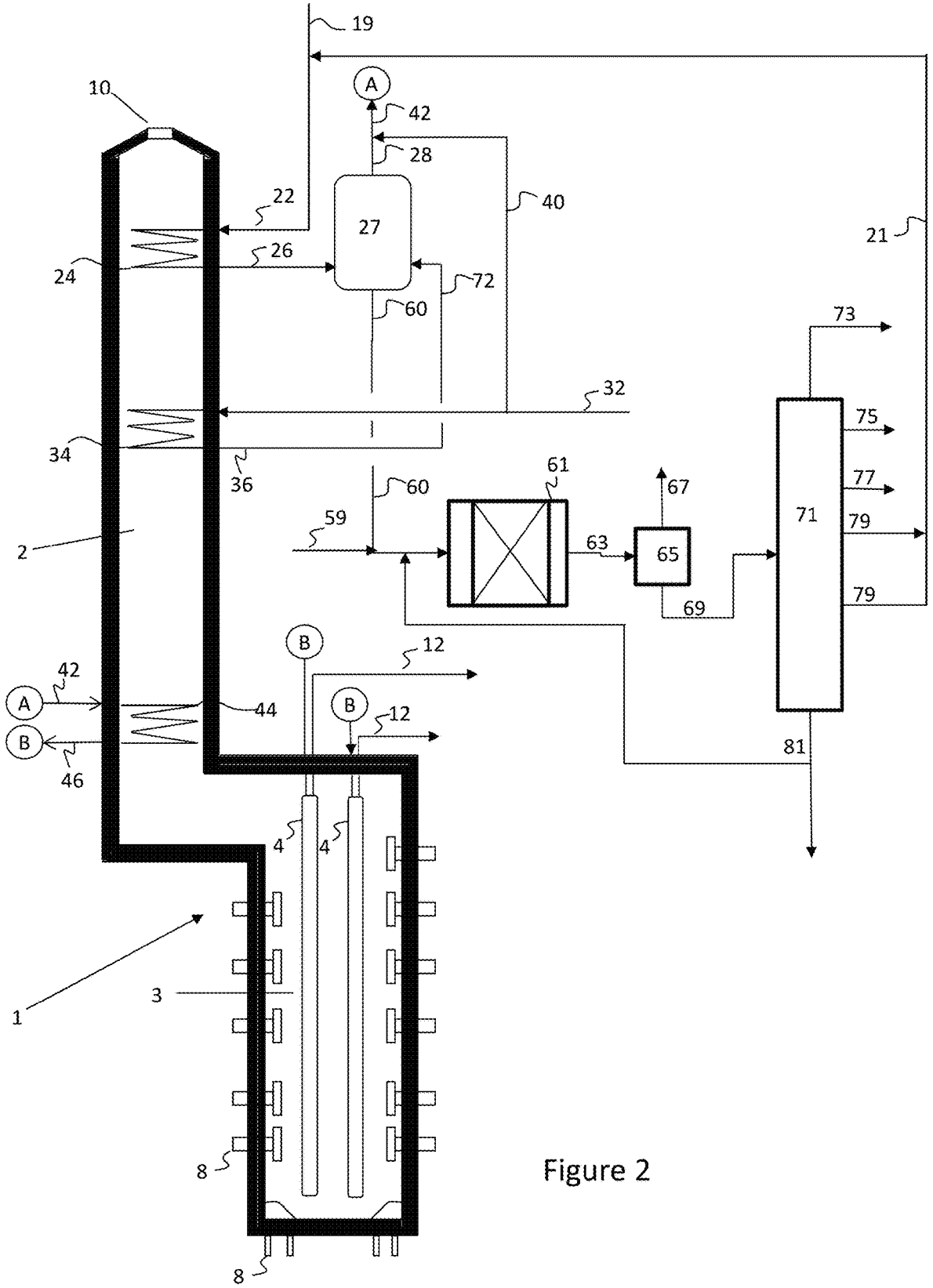
FIG. 2 is a simplified process flow diagram of an integrated pyrolysis-hydrocracking system for processing hydrocarbon mixtures according to embodiments herein.

FIG. 2 illustrates a simplified process flow diagram of one integrated pyrolysis and hydrocracking system according to embodiments herein. A fired tubular furnace 1 is used for cracking hydrocarbons to ethylene and other olefinic compounds. The fired tubular furnace 1 has a convection section or zone 2 and a cracking section or zone 3. The furnace 1 contains one or more process tubes 4 (radiant coils) through which a portion of the hydrocarbons fed through hydrocarbon feed line 22 are cracked to produce product gases upon the application of heat. Radiant and convective heat is supplied by combustion of a heating medium introduced to the cracking section 3 of the furnace 1 through heating medium inlets 8, such as hearth burners, floor burners, or wall burners, and exiting through an exhaust 10.

The hydrocarbon feedstock 22, which may be a mixture of a whole crude 19 and a gas oil 21, and which may include hydrocarbons boiling from naphtha range hydrocarbons to hydrocarbons having a normal boiling point temperature greater than 450° C., may be introduced to a heating coil 24, disposed in the convective section 2 of the pyrolysis heater 1. For example, hydrocarbon feedstocks with components having a normal boiling temperature greater than 475° C., greater than 500° C., greater than 525° C., or greater than 550° C. may be introduced to heating coil 24. In the heating coil 24, the hydrocarbon feedstock may be partially vaporized, vaporizing the lighter components in the hydrocarbon feedstock, such as naphtha range hydrocarbons. The heated hydrocarbon feedstock 26 is then fed to a separator 27 for separation into a vapor fraction 28 and a liquid fraction 60.

Steam may be supplied to the process via flow line 32. Various portions of the process may use low temperature or saturated steam, while others may use high temperature superheated steam. Steam to be superheated may be fed via flow line 32 into heating coil 34, heated in the convection zone 2 of the pyrolysis heater 1, and recovered via flow line 36 as superheated steam.

A portion of the steam may be fed via flow line 40 and mixed with vapor fraction 28 to form a steam/hydrocarbon mixture in line 42. The steam/hydrocarbon mixture in stream 42 may then be fed to a heating coil 44. The resulting superheated mixture may then be fed via flow line 46 to one or more cracking coils 4 disposed in a radiant zone 3 of the pyrolysis heater 1. The cracked hydrocarbon product may then be recovered via flow line 12 for heat recovery, quenching, and product recovery (not shown), as described above.

Superheated steam 36 can be injected via flow line 72 directly into separator 27. The injection of superheated steam into the separator may reduce the partial pressure and increase the amount of hydrocarbons in the vapor fractions 28. Steam or superheated steam may also be introduced to one or both of streams 22, 26.

Hydrogen 59 and the liquid fraction 60, which includes the high boiling point (residue) hydrocarbons in the feed mixture 22, may then be fed to a hydrocracking reactor system 61. Hydrocracking reactor system 61 may include one or more reaction zones, and may include fixed bed reactor(s), ebullated bed reactor(s) or other types of reaction systems known in the art.

In hydrocracking reactor system 61, the liquid fraction 60 may be contacted with a hydrocracking catalyst to crack a portion of the hydrocarbons in the liquid fraction to form lighter hydrocarbons, including olefins, among other products. An effluent 63 may be recovered from the hydrocracking reactor system 61, which may include unreacted hydrogen and various hydrocarbons. A separator 65 may then be used to separate the unreacted hydrogen 67 from the hydrocarbons 69 in the effluent. The hydrocarbon effluent 69 may then be fractionated in a fractionation system 71, which may include an atmospheric distillation tower and/or a vacuum distillation tower, to separate the effluent hydrocarbons into two or more hydrocarbon fractions, which may include one or more of a light petroleum gas fraction 73, a naphtha fraction 75, a jet or kerosene fraction 77, one or more atmospheric or vacuum gas oil fractions 79, and a residue fraction 81. The gas oil fraction(s) 79, or portion(s) thereof, may then be used as stream 21 and combined with whole crude 19 to form mixed hydrocarbon feed 22, integrating the hydrocracking reaction system with the pyrolysis unit. Residue fraction 81, or a portion thereof, may be returned to the hydrocracking reaction system for additional conversion and production of additional olefins.

Figure 3:
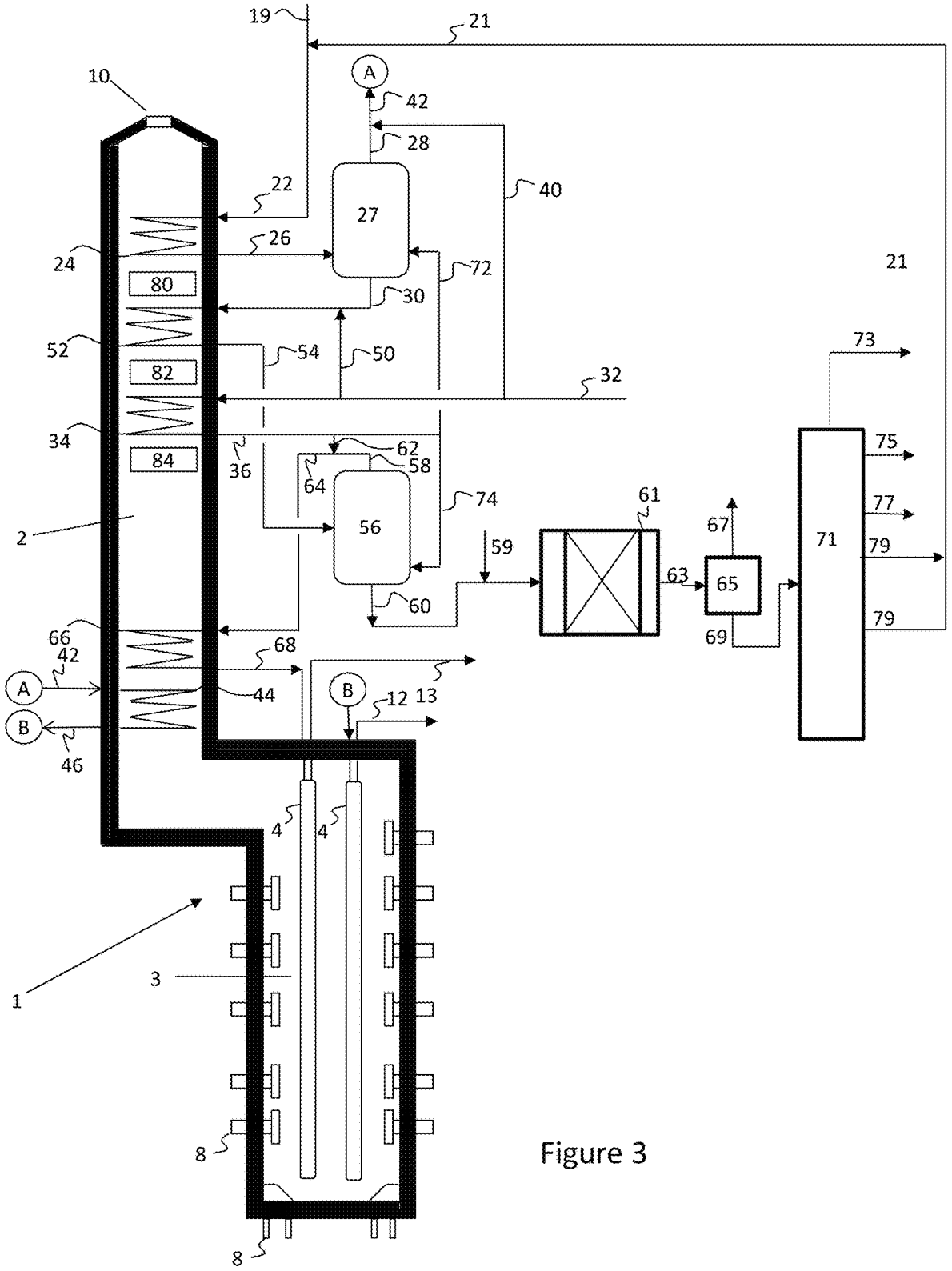
FIG. 3 is a simplified process flow diagram of an integrated pyrolysis-hydrocracking system for processing hydrocarbon mixtures according to embodiments herein.

FIG. 3 illustrates a simplified process flow diagram of an integrated pyrolysis and hydrocracking system according to embodiments herein. A fired tubular furnace 1 is used for cracking hydrocarbons to ethylene and other olefinic compounds. The fired tubular furnace 1 has a convection section or zone 2 and a cracking section or zone 3. The furnace 1 contains one or more process tubes 4 (radiant coils) through which a portion of the hydrocarbons fed through hydrocarbon feed line 22 are cracked to produce product gases upon the application of heat. Radiant and convective heat is supplied by combustion of a heating medium introduced to the cracking section 3 of the furnace 1 through heating medium inlets 8, such as hearth burners, floor burners, or wall burners, and exiting through an exhaust 10.

The hydrocarbon feedstock, such as a whole crude or a hydrocarbon mixture including hydrocarbons boiling from naphtha range hydrocarbons to hydrocarbons having a normal boiling point temperature greater than 450° C., may be introduced to a heating coil 24, disposed in the convective section 2 of the pyrolysis heater 1. For example, hydrocarbon feedstocks with components having a normal boiling temperature greater than 475° C., greater than 500° C., greater than 525° C., or greater than 550° C. may be introduced to heating coil 24. In the heating coil 24, the hydrocarbon feedstock may be partially vaporized, vaporizing the lighter components in the hydrocarbon feedstock, such as naphtha range hydrocarbons. The heated hydrocarbon feedstock 26 is then fed to a separator 27 for separation into a vapor fraction 28 and a liquid fraction 30.

Steam may be supplied to the process via flow line 32. Various portions of the process may use low temperature or saturated steam, while others may use high temperature superheated steam. Steam to be superheated may be fed via flow line 32 into heating coil 34, heated in the convection zone 2 of the pyrolysis heater 1, and recovered via flow line 36 as superheated steam.

A portion of the steam may be fed via flow line 40 and mixed with vapor fraction 28 to form a steam/hydrocarbon mixture in line 42. The steam/hydrocarbon mixture in stream 42 may then be fed to a heating coil 44. The resulting superheated mixture may then be fed via flow line 46 to a cracking coil 4 disposed in a radiant zone 3 of the pyrolysis heater 1. The cracked hydrocarbon product may then be recovered via flow line 12 for heat recovery, quenching, and product recovery.

In the same or a separate heater, the liquid fraction 30 may be mixed with steam 50 and fed to heating coil 52 disposed in the convective zone 2 of pyrolysis reactor 1. In heating coil 52, the liquid fraction may be partially vaporized, vaporizing the remaining lighter components in the hydrocarbon feedstock, such as mid to gas oil range hydrocarbons. The injection of steam into the liquid fraction 30 may help prevent formation of coke in heating coil 52. The heated liquid fraction 54 is then fed to a separator 56 for separation into a vapor fraction 58 and a liquid fraction 60.

A portion of the superheated steam may be fed via flow line 62 and mixed with vapor fraction 58 to form a steam/hydrocarbon mixture in line 64. The steam/hydrocarbon mixture in stream 64 may then be fed to a heating coil 66. The resulting superheated mixture may then be fed via flow line 68 to a cracking coil 4 disposed in a radiant zone 3 of the pyrolysis heater 1. The cracked hydrocarbon product may then be recovered via flow line 13 for heat recovery, quenching, and product recovery.

Superheated steam can be injected via flow lines 72, 74 directly into separators 27, 56, respectively. The injection of superheated steam into the separators may reduce the partial pressure and increase the amount of hydrocarbons in the vapor fractions 28, 58.

In addition to heating the hydrocarbon and steam streams, the convection zone 2 may be used to heat other process streams and steam streams, such as via coils 80, 82, 84. For example, coils 80, 82, 84 may be used to heat BFW (Boiler feed water) and preheating SHP (super high pressure) steam, among others.

The placement and number of coils 24, 52, 34, 44, 66, 80, 82, 84 can vary depending upon the design and the expected feedstocks available. In this manner, convection section may be designed to maximize energy recovery from the flue gas. In some embodiments, it may be desired to dispose superheating coil 44 at a higher flue gas temperature location than superheating coil 66. Cracking of the lighter hydrocarbons may be carried out at higher severity, and by locating the superheating coils appropriately, cracking conditions may be enhanced or tailored to the specific vapor cut. Likewise, where the vapor fractions are processed in separate heaters, the location of the coils, heater conditions, and other variables may be independently adjustable to match the cracking conditions to the desired severity.

Figure 6:
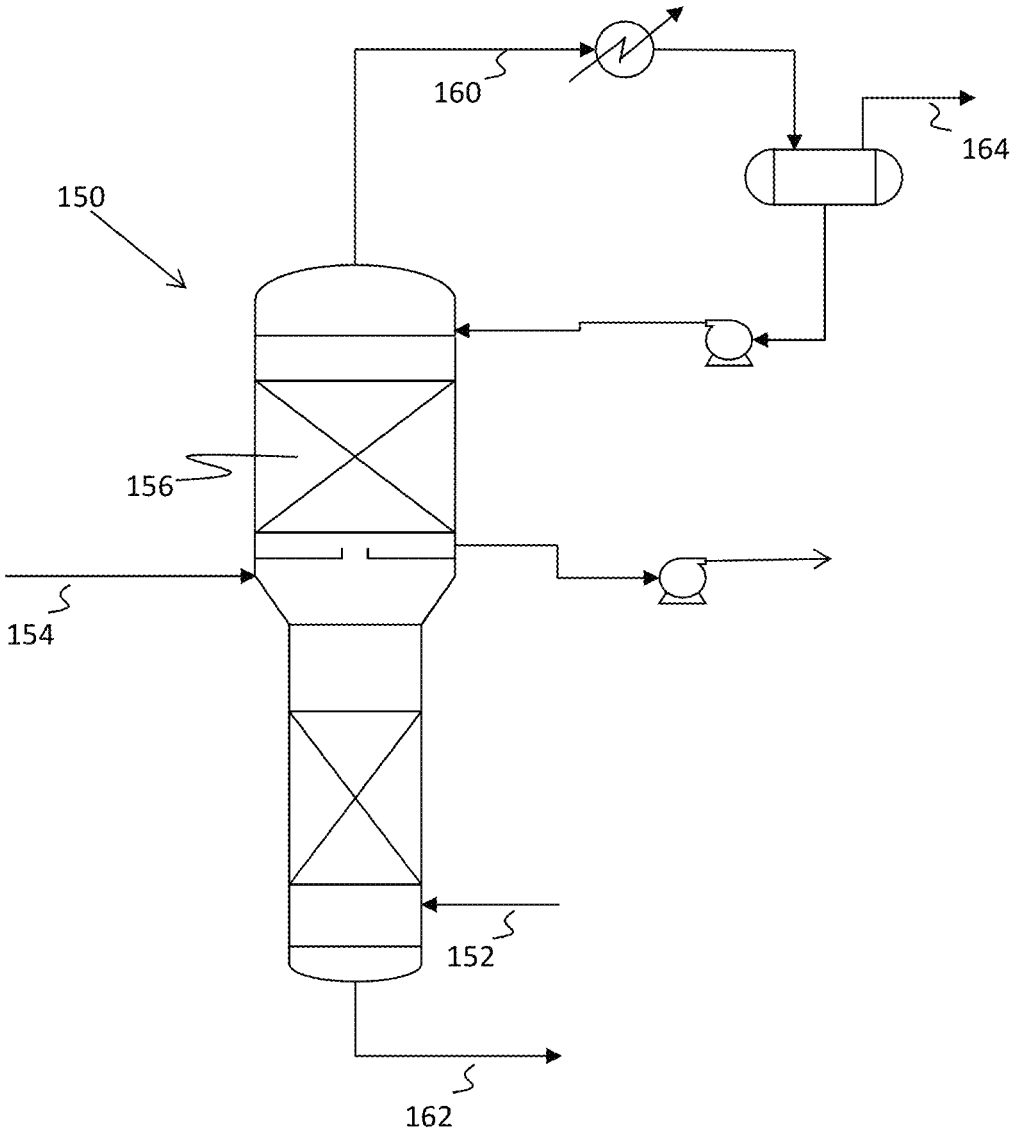
FIG. 6 is a simplified process flow diagram of a HOPS tower useful with the integrated pyrolysis-hydrocracking systems for processing hydrocarbon mixtures according to embodiments herein.

In some embodiments, first separator 27 may be a flash drum, and second separator 56 may be a heavy oil processing system (HOPS) tower, as illustrated in FIG. 6, described below.

Liquid fraction 60 may then be processed in an integrated hydrocracking system as described above with respect to FIG. 2. Hydrogen 59 and the liquid fraction 60, which includes the high boiling point (residue) hydrocarbons in the feed mixture 22, may be fed to a hydrocracking reactor system 61, which may include one or more reaction zones, and may include fixed bed reactor(s), ebullated bed reactor (s) or other types of reaction systems known in the art.

In hydrocracking reactor system 61, the liquid fraction 60 may be contacted with a hydrocracking catalyst to crack a portion of the hydrocarbons in the liquid fraction to form lighter hydrocarbons, including olefins, among other products. An effluent 63 may be recovered from the hydrocracking reactor system 61, which may include unreacted hydrogen and various hydrocarbons. A separator 65 may then be used to separate the unreacted hydrogen 67 from the hydrocarbons 69 in the effluent. The hydrocarbon effluent 69 may then be fractionated in a fractionation system 71, which may include an atmospheric distillation tower and/or a vacuum distillation tower, to separate the effluent hydrocarbons into two or more hydrocarbon fractions, which may include one or more of a light petroleum gas fraction 73, a naphtha fraction 75, a jet or kerosene fraction 77, one or more atmospheric or vacuum gas oil fractions 79, and a residue fraction 81. The gas oil fraction(s) 79, or portion(s) thereof, may then be used as stream 21 and combined with whole crude 19 to form mixed hydrocarbon feed 22, integrating the hydrocracking reaction system with the pyrolysis unit. Residue fraction 81, or a portion thereof, may be returned to the hydrocracking reaction system for additional conversion and production of additional olefins.

While not illustrated in FIG. 2 or 3, additional hydrocarbons in liquid fraction 60 may be volatilized and cracked, maximizing olefin recovery of the process. For example, liquid fraction 60 may be mixed with steam, forming a steam/oil mixture. The resulting steam/oil mixture may then be heated in the convection zone 2 of pyrolysis reactor 1 to vaporize a portion of the hydrocarbons in the steam/oil mixture. The heated stream may then be fed to a third separator to separate the vapor fraction, such as vacuum gas oil range hydrocarbons, from the liquid fraction. Superheated steam may also be introduced to the separator to facilitate separations, as well as to the recovered vapor fraction to prevent condensation in the transfer lines prior to introducing the vapor fraction to cracking coils to produce olefins. The liquid fraction recovered from the separator may include the heaviest boiling components of the hydrocarbon mixture 22, such as hydrocarbons having a normal boiling point temperature of greater than 520° C. or 550° C., and this resulting liquid fraction may be further processed through the integrated hydrocracking system as described above with respect to FIGS. 2 and 3.

The configuration of FIGS. 2 and 3 provides significant advantages over the traditional process of pre-fractionating the entirety of the mixed hydrocarbon feedstock into separately processed fractions. Additional process flexibility, such as the ability to process widely variable feedstocks, may be attained with the embodiment illustrated in FIG. 4.

Figure 4:
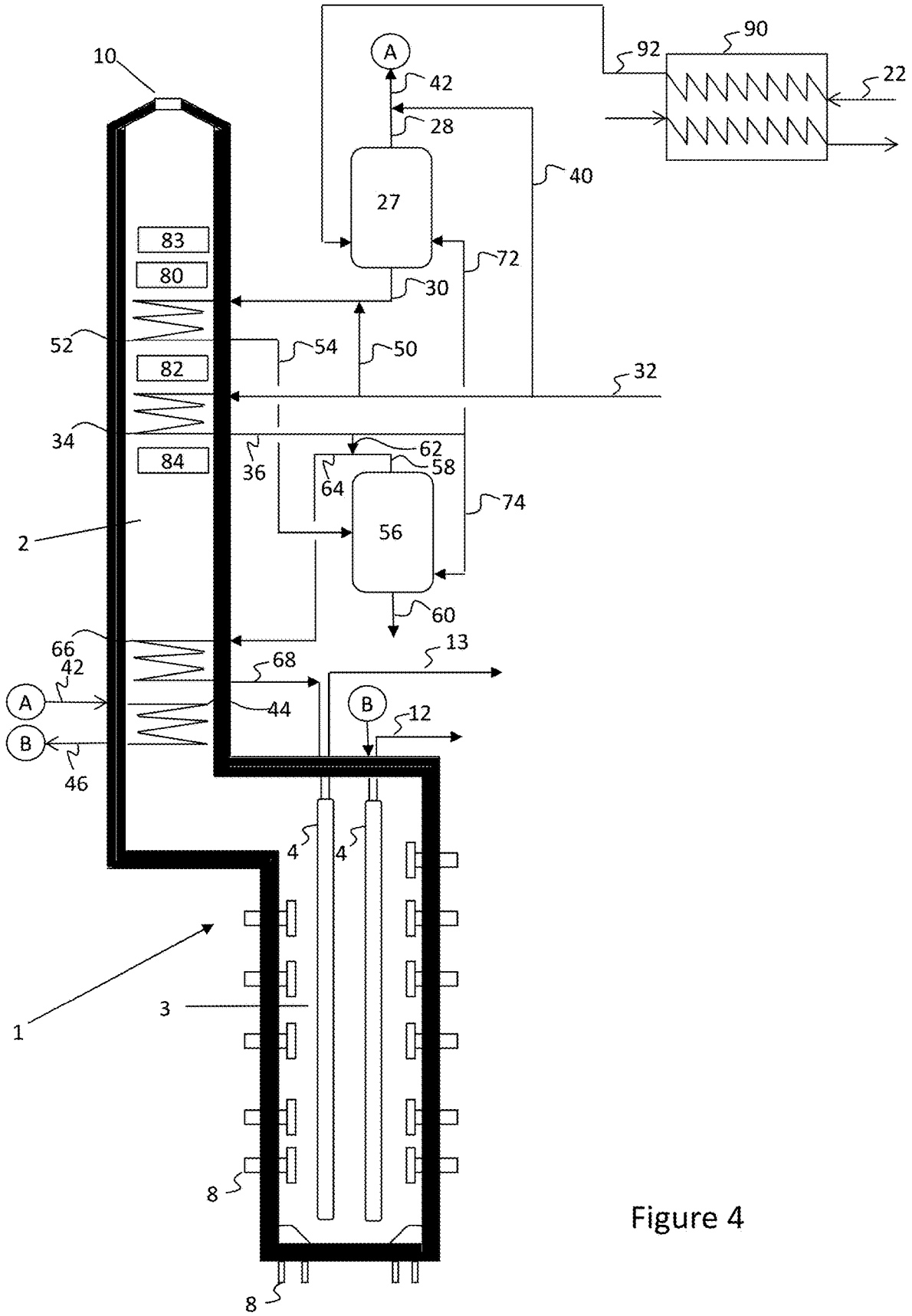
FIG. 4 is a simplified process flow diagram of an integrated pyrolysis-hydrocracking system for processing hydrocarbon mixtures according to embodiments herein.

As illustrated in FIG. 4, where like numerals represent like parts, a mixed hydrocarbon feed 22 may be fed to a heater 90. In heater 90, the hydrocarbon feed may be contacted in indirect heat exchange to increase a temperature of the hydrocarbon feed 22, resulting in a heated feed 92. Heated feed 92 may remain a liquid or may be partially vaporized.

Heated feed 92 may then be introduced to separator 27 to separate lighter hydrocarbons from heavier hydrocarbons. Steam 72 may also be introduced to separator 27 to increase the volatilization of the lighter hydrocarbons. The vapor fraction 28 and liquid fraction 30 may then be processed as described above with respect to FIGS. 2 and 3, cracking one or more vapor fractions to produce olefins and recovering a heavy hydrocarbon fraction containing hydrocarbons having very high normal boiling points, such as greater than 550° C.

When crude preheating is done externally in an exchanger or in a preheater, as shown in FIG. 4, economizers or BFW coils 83 can occupy the top row(s) of convection section 2. To improve efficiency further, flue gas from two or more heaters can be collected and a combined flue gas can be used to recover additional heat, such as by preheating the feed, preheating the combustion air, low pressure steam generation or heating other process fluids.

Steam has a very low heat capacity, and the heat of vaporization of oil is also significant. Further, the heat energy available in the convection zone of a pyrolysis reactor is not infinite, and the multiple tasks of volatilizing the hydrocarbon feed, superheating steam, and superheating the hydrocarbon/steam mixtures to the radiant coils, may result in rejection of a high amount of high boiling material. A separate heater may be used to preheat the hydrocarbon feedstock and/or dilution steam, resulting in the overall process having a higher degree of flexibility in processing hydrocarbon mixtures having both low and high amounts of heavier hydrocarbons and improving the overall olefin yield from the hydrocarbon mixture.

Figure 5:
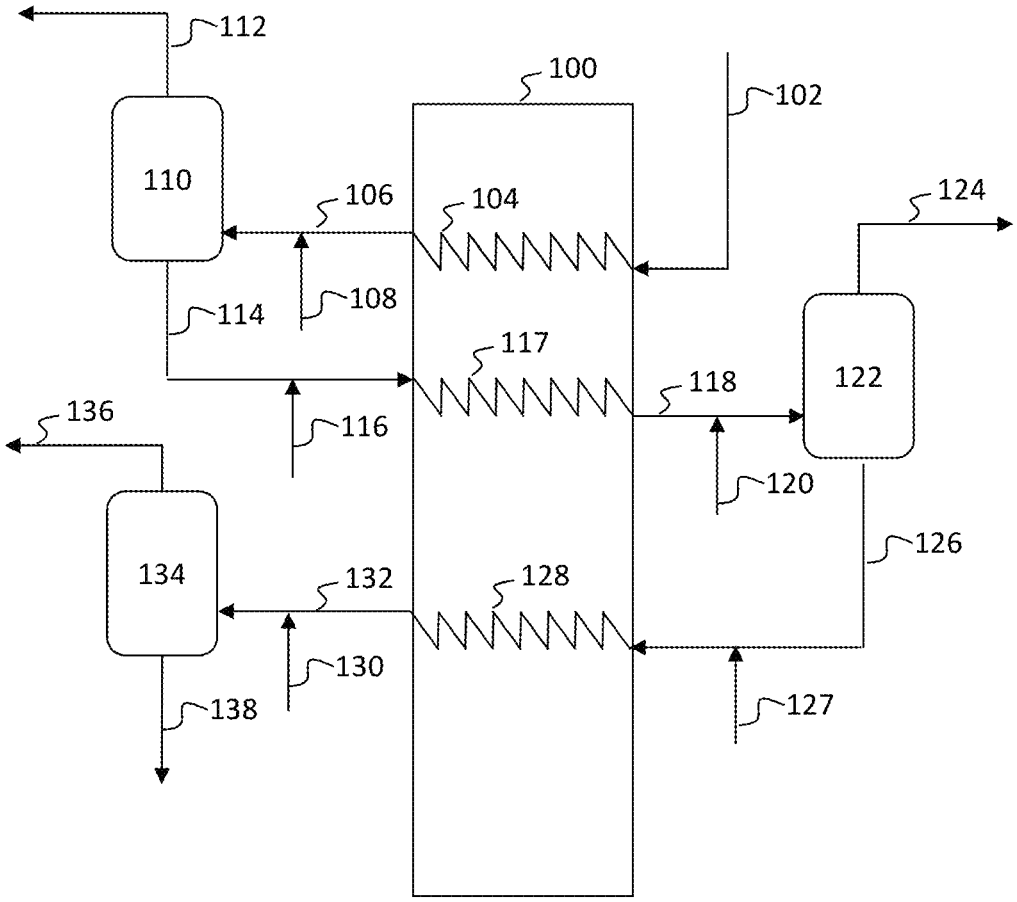
FIG. 5 is a simplified process flow diagram of an integrated pyrolysis-hydrocracking system for processing hydrocarbon mixtures according to embodiments herein.

This concept is extended in FIG. 5, where a dedicated heater 100 is used to preheat only the hydrocarbon feedstock. Heater 100 preferably does not crack any feed to olefins; rather, it takes the role of the convection section heating as described above. Temperatures recited with respect to FIG. 5 are exemplary only, and may be varied to achieve the desired hydrocarbon cuts.

Crude 102 is fed to a heating coil 104 and preheated in heater 100 to a relatively low temperature. The heated feed 106 is then mixed with steam 108, which may be dilution steam or superheated dilution steam. The preheating and steam contact may vaporize hydrocarbons having a normal boiling point of about 200° C. and less (i.e., a naphtha fraction). The volatilized hydrocarbons and steam may then be separated from non-volatilized hydrocarbons in drum 110, recovering a vapor fraction 112 and a liquid fraction 114. The vapor fraction 112 may then be further diluted with steam, if necessary, superheated in a convection section and sent to radiant coils of a pyrolysis reactor (not shown).

Liquid fraction 114 may be mixed with dilution steam 116, which may be a saturated dilution steam, fed to heating coil 117 and heated in the fired heater 100 to moderate temperatures. The heated liquid fraction 118 may then be mixed with superheated dilution steam 120 and the mixture fed to flash drum 122. Hydrocarbons, boiling in the range from about 200° C. to about 350° C., are vaporized and recovered as a vapor fraction 124. The vapor fraction 124 may then be superheated and sent to a radiant section of a pyrolysis reactor (not shown).

The liquid fraction 126 recovered from flash drum 122 is again heated with saturated (or superheated) dilution steam 127, and passed through coils 128 and further superheated in the fired heater 100. Superheated dilution steam 130 may be added to the heated liquid/vapor stream 132 and fed to separator 134 for separation into a vapor fraction 136 and a liquid fraction 138. This separation will cut a 350° C. to 550° C. (VGO) portion, recovered as a vapor fraction 136, which may be superheated with additional dilution steam, if required, and sent to a radiant section of a pyrolysis reactor (not shown).

In some embodiments, separator 134 may be a flash drum. In other embodiments, separator 134 may be a HOPS tower. Alternatively, separation system 134 may include both a flash drum and a HOPS tower, where vapor fraction 136 may be recovered from a flash drum and is then further heated with dilution steam and fed to a HOPS tower. Where a HOPS unit is used, only vaporizable material will be cracked. Unvaporized material 138 may be recovered and sent to fuel, for example or further processed to produce additional olefins as described below. Additional dilution steam will be added to the vapor before sending it to a radiant section of a pyrolysis reactor (not shown). In this manner, with a separate fired heater, many cuts are possible and each cut can be optimally cracked.

For each of the embodiments described above, a common heater design is possible. To increase the thermal efficiency of such a heater, the top row (cold sink) can be any low temperature fluid or BFW or economizer, such as shown in FIG. 4. The heating and superheating of the fluids with or without steam can be done in the convection section or in the radiant section or in the both sections of the fired heater. Additional superheating may be done in the convection section of the cracking heater. In the heaters, maximum heating of the fluid should be limited to temperatures lower than the coking temperatures of the crude, which for most crudes may be around 500° C. At higher temperatures, sufficient dilution steam should be present to suppress coking.

Dilution steam can also be superheated so that the energy balance of the cracking heater does not affect the cracking severity significantly. Typically, dilution steam is superheated in the same heater (called integral) where the feed is cracked. Alternatively, the dilution steam can be superheated in separate heaters. Use of an integral or separate dilution steam super heater depends upon the energy available in the flue gas.

A simple sketch of a HOPS tower 150 is shown in FIG. 6. Various modifications of this scheme are possible. In the HOPS tower, superheated dilution steam 152 is added to hot liquid 154, and a separation zone 156 including 2 to 10 theoretical stages are used to separate the vaporizable hydrocarbons from the non-vaporizable hydrocarbons. By this process, carryover of fine droplets to the overhead fraction 160 is reduced, as high boiling carryover liquids in the vapor will cause coking. The heavy, non-vaporizable hydrocarbons are recovered in bottoms fraction 162, and the vaporizable hydrocarbons and dilution steam are recovered in overhead product fraction 164. HOPS tower 150 may include some internal distributors with and/or without packing. When the HOPS tower is used, vapor/liquid separation may be nearly ideal. The end point of the vapor is predictable, based on operating conditions, and any liquid carry over in the vapor phase can be minimized. While this option is more expensive than a flash drum, the benefits of reduced coking sufficiently outweigh the added expense. The liquids in stream 162 by be recycled to an appropriate stage of the process for continued processing.

In embodiments herein, all vapor fractions may be cracked in the same reactor in different coils. In this manner, a single heater can be used for different fractions and optimum conditions for each cut can be achieved. Alternatively, multiple heaters may be used.

The resulting non-volatized material, such as that in streams 60, 138, may be fed to an integrated hydrocracking unit, as illustrated and described above with respect to FIGS. 2 and 3.

In some embodiments, it may be desired to further process one or more of the liquid fractions, such as liquid fraction 30 or 60, to remove metals, nitrogen, sulfur, or Conradson Carbon Residue prior to further processing within the integrated hydrocracking and pyrolysis system. One configuration for this further treatment and integration according to embodiments herein is illustrated in FIG. 7.

Figure 7:
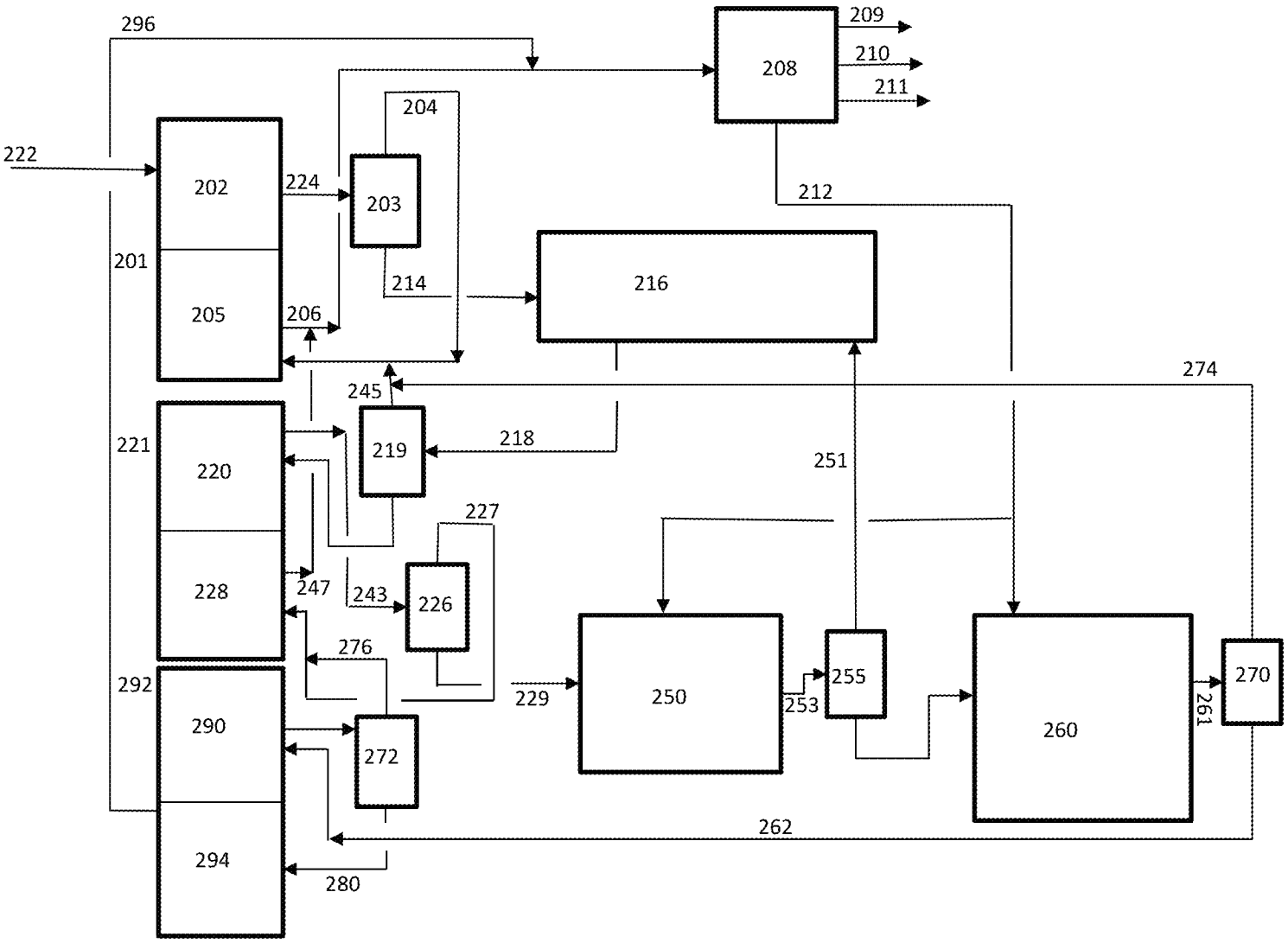
FIG. 7 is a simplified process flow diagram of an integrated pyrolysis-hydrocracking system for processing hydrocarbon mixtures according to embodiments herein.

As illustrated in FIG. 7, a hydrocarbon mixture 222, such as a whole crude or a whole crude mixed with a gas oil, as described above for feed 22 with respect to FIGS. 2 and 3 for example, is sent to the convection zone 202 of a pyrolysis heater 201. The heated mixture 224 is flashed in separator 203 and the vapor fraction 204 is sent to pyrolysis heater 201 reaction section (radiant zone) 205, where the vapor stream is converted to olefins. The resulting effluent 206 is then sent to an olefins recovery section 208, where the hydrocarbons may be separated via fractionation into various hydrocarbon cuts, such as a light petroleum gas fraction 209, a naphtha fraction 210, a jet or diesel fraction 211, and a heavies fraction 212.

The liquid portion 214 recovered from separator 203 may be hydrotreated in a fixed bed reactor system 216 to remove one or more of metals, sulfur, nitrogen, CCR, and asphaltenes and to produce a hydrotreated liquid 218 with lower density. The liquid 218 is then sent to the convection zone 220 of a pyrolysis heater 221. A separator 219 may be used to remove vapors 245 from the hydrotreated liquid 218 in some embodiments, where vapors 245 may be reacted in reaction section 205 of pyrolysis heater 201, in the same or a different coil as vapor 204.

The heated mixture 243 resulting from heating of liquid 218 in convection zone 220 is then flashed in a separator 226 and the vapor 227 is sent to pyrolysis heater 221 reaction zone 228, where the vapor stream is converted to olefins and sent via flow line 247 to the olefins recovery section 208.

The liquid 229 from separator 226 is sent to an ebullated bed or slurry hydrocracking reactor 250 for quasi-total conversion of the liquid boiling nominally above 550° C. to convert the hydrocarbons to <550° C. products. The effluent 253 from hydrocracking reaction zone 250 may be fed to separation zone 255, where lighter products 251 from the reactor effluent are distilled off and sent to respective pyrolysis reactor zones in heaters 201 and 221, and may be routed through hydrotreaters 216 or simply combined with similar boiling range streams being fed to the pyrolysis reactor zones.

The liquid 212 from fractionation section 208 (essentially 370-550° C.) is sent to a full conversion hydrocracking unit 260 integrated with the rest of the ebullated bed or slurry hydrocracking system 250 for total conversion to naphtha 261 or a naphtha and unconverted oil stream 261. In the case of all naphtha product in stream 261, the naphtha 261 may be processed in a reaction zone of a separate pyrolysis heater (not illustrated) or a heater coil within one of reaction zones 205, 228. In other embodiments, the naphtha and unconverted oil stream 261 may be separated in one or more separators 270, 272 into various fractions 274, 276 which may be fed to reaction zones 205, 228 for co-processing or separate processing with vapor fractions 204, 245, 227 in the respective reaction zones 205, 228. Heating and separation of the unconverted oil stream, or a portion thereof, may occur in a convection section 290 of a pyrolysis heater 292. The liquids 280 in the unconverted oil stream may then be sent to its own pyrolysis reaction section 294 in pyrolysis heater 292 for conversion to olefins. The pyrolysis effluent 296 may then be fed to olefin recovery zone 208.

Embodiments herein may eliminate the refinery altogether while making the crude to chemicals process very flexible in terms of crude. The processes disclosed herein are flexible for crudes with high levels of contaminants (sulfur, nitrogen, metals, CCR) and this distinguishes it from whole crude processes that can handle only very light crudes or condensates. As opposed to hydrotreating the entirety of the whole crude, that would involve very large reactor volumes and inefficient in terms of hydrogen addition, processes herein only add hydrogen as required and at the right point in the process.

Further, embodiments herein utilize a unique blend of pyrolysis convection and reaction zones for processing different types of feeds derived from selective hydrotreating and hydrocracking of crude components. Complete conversion of crude may be achieved without a refinery.

The vapor and liquid produced in the convection section may be efficiently separated via the HOPS separators. Embodiments herein use the first heater's convection section to separate light components that can be readily converted to olefins and do not need hydrotreating. The liquid may then be efficiently hydrotrated to remove heteroatoms that impact yield/fouling rate prior to further pyrolysis using a fixed bed catalyst system for HDM, DCCR, HDS and HDN. Embodiments herein may also use an ebullated bed or slurry hydrocracking reaction and catalyst system for conversion of the heaviest components in crude in an intermediate step.

Embodiments herein may further utilize a fixed bed hydrocracking system to convert the low density, aromatic products derived from conversion of the heaviest crude components to high hydrogen content products that can then be sent for pyrolysis. Embodiments herein may also minimize the production of pyrolysis fuel oil by careful addition of hydrogen and by conducting the pyrolysis reaction in dedicated heaters tailored to the feed being processed. The pyrolysis oil production is minimized by the hydrogenation systems being able to handle different cuts of feed, such as by the separation of the feeds in HOPS separators. The pyrolysis oil produced by embodiments herein is recovered and hydroprocessed within the different hydrocracking sections, avoiding export of low value pyrolysis oil.

Further, a feature of embodiments herein is hydrocracking of pyrolysis fuel oil and thermally cracking the hydrocracked material. Typical VGO contains about 12-13 wt % hydrogen while PFO contains about 7 wt % hydrogen. In addition, the PFO may contain a significant amount of polynuclear aromatics, including hydrocarbon molecules having greater than 6 rings. Therefore, it is easier to hydrocrack vacuum gas oil than PFO. The hydrocracker in embodiments herein may be designed to handle such heavy feeds.

EXAMPLES

Example 1: Arabian Crude

Table 1 shows the calculated yields obtained for crude cracking. All calculations are based on a theoretical model. Assuming run length (even few hours) is not a factor, yields at high severity are shown, although other severities may be used.

For this Example, a Nigerian light crude is considered. The crude had the properties and distillation curve as shown in Table 1.

TABLE 1

| | |
|---|---|
| Specific Gravity | 0..79 |
| Sulfur, wt % | 0.04 |
| Micro-carbon residue (MCRT), wt % | 0.67 |
| metals, ppm | 2.1 |
| C7 Asphaltene, wt % | 0.11 |

| TBP End Point ° C. | Cumulative Yield (wt %) |
|---|---|
| <80 | 11.7 |
| 150 | 30.2 |
| 200 | 43.5 |
| 260 | 58.1 |
| 340 | 78.2 |
| 450 | 93.6 |
| 570 | 97.7 |
| Residue (570° C.+) | 100 |

Simulated pyrolysis yields for cracking the crude, calculated based on a model, are shown in Table 2. Three cases were studied for this example, including: Case 1—whole crude with gas oil product integration; Case 2—whole crude with gas oil integration and a resid hydrocracker, and a reference case, Case 3—pyrolysis of a full range naphtha.

A naphtha cut (<200° C.), gas oil cut (200-340° C., and VGO+ (>340° C.) are considered. In Case 1, naphtha and gas oil cuts are as such cracked in the pyrolysis coils. VGO+ material is sent to a residue hydrocracker. The products of the hydrocracker are sent to the pyrolysis unit. A small fraction is removed from the hydrocracker as bleed to minimize the hydrocracker fouling rate.

In Case 2, pyrolysis gas oil and pyrolysis fuel oil (205° C.+) produced are sent to the residue hydrocracker and the products from the hydrocracker are sent to the pyrolysis unit, similar to Case 1.

For all cases, the feeds are cracked to high severity to minimize the feed consumption. A reference, typical full range naphtha is considered. The naphtha properties are: specific gravity=0.708, initial boiling point=32° C., 50 vol %=110° C., end boiling point=203° C.; paraffins=68 wt %, naphtherenes=23.2 wt %, and aromatics=8.8 wt %.

For all cases, ethane and propane produced in the olefin plant are recycled to extinction. Ethane is cracked at 65% conversion level. High selective two SRT heater is used for this example. Coil outlet pressure is chosen at 1.7 bara.

The following table shows the material balance for a typical 1 million metric ton of ethylene production at high severity.

TABLE 2

| | Case 1 | Case 2 | Case 3 |
|---|---|---|---|
| FEED | | | |
| Crude to Complex (wt. units) | 3130.7 | 2937.9 | |
| Naphtha to Complex | | | 2970 |
| Reaction Steam | 3.5 | 3.5 | 3.3 |
| Total Feed | 3134.2 | 2941.4 | 2973.3 |
| SEVERITY | High | High | High |
| Products, | | | |
| H2 + fuel gas | 456 | 457.8 | 516.2 |
| C2H4 | 1000 | 1000 | 1000 |
| C3H6 | 448.1 | 454.3 | 422.1 |
| Raw C4s | 276.9 | 279.8 | 245.9 |
| Pygas C5 to 240° C. | 651.1 | 666 | 631.5 |
| PGO/PFO | 174.9 | — | 155.9 |
| Acid Gases | 1.8 | 1.8 | 1.7 |
| Residue | 125.2 | — | 0 |
| Bleed as PFO | — | 81.8 | 0 |
| Total | 3134.2 | 2141.4 | 2973.3 |
| Ultimate C2H4 yield, wt % | 31.94 | 34.03 | 33.67 |
| Ultimate C3H6 yield, wt % | 14.31 | 15.46 | 14.21 |
| Ultimate C2H4 + C3H6 yield, wt % | 46.25 | 49.5 | 47.88 |

Hydrocracking the heavies and sending the products to the olefin plant as feedstock produces ultimate yields comparable to a naphtha cracker. When a resid hydrocracker is not used, not only resid is hydrocracked, but also the fuel oil produced in the olefin complex can be hydrocracked and integrated as a feed to the olefin complex. This improves the ultimate yield and is better than a typical naphtha cracker. Without separating the crude to various fractions, crude can be processed in the olefins complex by integrating with a conventional hydrocracker and/or a resid hydrocracker. This will improve the ultimate olefin production, minimizing the feed consumption and improving the economics of crude cracking. Less valuable fuel oil production is significantly reduced, preserving the resources.

When high value fuels like kerosene and/or diesel are required, these products can be obtained from the distillation column used in the hydrocracker. These may not be routed to the olefin complex—as they have gone through a hydrocracker, they will also meet the fuel specification, avoiding separate hydroproces sing units required with crude distillation unit when they are produced from the crude column. This reduces the capital investment. Further, the flowsheets proposed herein may be modified to meet the required olefin to fuel ratio.

Example 2

Using an Arabian crude, the following material balance is generated.

Material Balance for 11564 KTA Crude feed LPG Free basis

| CASE | 1A | 2A | 3A | 1B | 2B | 3B |
|---|---|---|---|---|---|---|
| Vacuum Residue Cracking? | No | Yes | Yes | No | Yes | Yes |
| Fuel Oil Recycle? | No | No | Yes | No | No | Yes |
| Cracking Severity | High | High | High | Low | Low | Low |
| Light gas | 668.4 | 668.4 | 668.4 | 668.4 | 668.4 | 668.4 |
| Light Naphtha | 2889.2 | 2889.2 | 2889.2 | 2889.2 | 2889.2 | 2889.2 |
| Heavy Naphtha | 2390.0 | 2390.0 | 2390.0 | 2390.0 | 2390.0 | 2390.0 |
| Heavy Blend 2 | 4052.4 | 4052.4 | 4052.4 | 4052.4 | 4052.4 | 4052.4 |
| Vacuum Residue | 1564.3 | 1564.3 | 1564.3 | 1564.3 | 1564.3 | 1564.3 |
| Methanol | 114.3 | 136.3 | 150.7 | 198.9 | 231.0 | 255.2 |
| Net Steam Reacted | 11.9 | 13.8 | 15.0 | 13.1 | 15.1 | 16.5 |
| TOTAL | 11690.5 | 11714.4 | 11730.0 | 11776.3 | 11810.4 | 11836.0 |
| PRODUCTS, KTA | | | | | | |
| Hydrogen | 35.9 | 39.9 | 42.6 | 10.3 | 11.4 | 12.2 |
| Fuel Gas | 1706.9 | 1937.6 | 2088.3 | 1528.8 | 1732.4 | 1885.5 |
| Ethylene | 3637.8 | 4114.8 | 4426.5 | 3435.5 | 3884.6 | 4222.5 |
| Propylene from Cracker | 1572.7 | 1822.3 | 1985.3 | 1926.7 | 2205.0 | 2414.3 |
| 1,3-Butadiene | 512.3 | 588.6 | 638.5 | 540.1 | 618.9 | 678.2 |
| MTBE | 314.5 | 375.0 | 414.5 | 547.3 | 635.5 | 701.9 |
| 1-Butene | 57.9 | 67.3 | 73.5 | 119.9 | 134.0 | 144.5 |
| C9+ Gasoline | 238.9 | 289.6 | 0.0 | 261.9 | 315.1 | 0.0 |
| Benzene | 697.5 | 819.0 | 898.3 | 435.8 | 502.9 | 553.4 |
| Toluene | 527.1 | 575.4 | 607.0 | 518.6 | 561.3 | 593.5 |
| Xylene | 208.6 | 247.8 | 273.5 | 242.0 | 278.4 | 305.9 |
| Pyrolysis Gas Oil | 172.3 | 256.8 | 0.0 | 175.3 | 284.7 | 0.0 |
| Pyrolysis Fuel Oil | 435.5 | 570.9 | 0.0 | 461.1 | 636.2 | 0.0 |
| Residue | 1564.3 | 0.0 | 0.0 | 1564.3 | 0.0 | 0.0 |
| FO Recycle --> Vent Gases | 0.0 | 0.0 | 32.1 | 0.0 | 0.0 | 37.0 |
| FO Recycle --> Fuel Oil Residue | 0.0 | 0.0 | 240.0 | 0.0 | 0.0 | 276.4 |
| Acid Gases | 8.3 | 9.3 | 9.9 | 8.9 | 9.9 | 10.7 |
| TOTAL | 11690.5 | 11714.4 | 11730.0 | 11776.3 | 11810.4 | 11836.0 |
| RECYCLES, KTA | | | | | | |
| C2 Recycle | 555.1 | 635.9 | 688.6 | 638.9 | 724.6 | 789.0 |
| C3 Recycle | 123.2 | 175.3 | 209.4 | 140.3 | 193.1 | 232.9 |
| C4-C5 THU Recycle | 534.6 | 666.3 | 752.3 | 1073.9 | 1254.4 | 1390.2 |
| C6-C8 Non-Aromatics Recycle | 223.5 | 274.9 | 308.5 | 687.2 | 770.5 | 833.2 |
| Fuel Oil Recycle to Cracking | 0.0 | 0.0 | 969.8 | 0.0 | 0.0 | 1116.8 |
| Fuel Oil Recycle to Purge | 0.0 | 0.0 | 52.0 | 0.0 | 0.0 | 59.9 |

For this balance 10,000 KTA of residue free crude liquid without LPG and mixed with the corresponding 1564.3 kTA of residue is chosen as basis. Residue free portion is the conventional feed. At high severity (Case 1A) it produces 3637.8 kTA of ethylene and 1572.7 kTA of propylene. At low severity (case 1B) the same amount of feed produces 3435.5 kTA of ethylene and 11926.7 kTA of propylene. The crude contains residue and to obtain 10,000 KTA of crackable material, 11564.3 kTA of crude has to be used and 1564.3 kTA of residue will be rejected. Currently cracakable feeds are light gases (668.4 kTA), light naphtha (2889.2 kTA), heavy naphtha (2390. KTA) and heavy oil (4052.4 kTA). Cases 1A, 2A, 3A are cracking all feeds in the olefin plant at high severity. Cases 1B, 2B and 3B are the corresponding low severity cases.

Cases 1A, 1B use gaseous feed, naphtha feed and heavy boiling material in the conventional way. Some of the heavy boiling material is hydrocracked to produce feed to the olefin plant.

Cases 2A, 2B use the same feed and the residue is hydrocracked in residue hydroprocessing unit and the products of the hydrocracker are cracked in addition to the feeds used in cases 1A or 1B.

Cases 3A, 3B use all the feeds used in 2A or 2B and also crack hydroprocessed pyrolysis fuel oil (PFO). This pyrolysis fuel oil is hydrocracked in a special hydrocracker. PFO is produced is produced in the cracker and recycled back to cracker after hydrocracking.

With residue cracking and recycle PFO hydrocracking, ethylene and propylene productions are significantly increased, as shown in the table below. All values are in KTA (kilotons per year).

| | CASE1A | CASE1B | CASE1C | CASE2A | CASE2B | CASE2C |
|---|---|---|---|---|---|---|
| HC Feed | 10000 | 10000 | 10000 | 10000 | 10000 | 10000 |
| Residue | 1564.3 | 1564.3 | 1564.3 | 1564.3 | 1564.3 | 1564.3 |
| Total | 11564.3 | 11564.3 | 11564.3 | 11564.3 | 11564.3 | 11564.3 |
| C2H4 | 3637.8 | 4114.8 | 44426.5 | 3435.5 | 3884.6 | 4222.5 |
| C3H6 | 1572.7 | 1822.3 | 1985.3 | 1926.7 | 2205 | 2414.3 |
| C2H4 + C3H6 | 5210.5 | 5937.1 | 6411.8 | 5362.2 | 6089.6 | 6636.8 |
| % C2 + C3yield | 45.06 | 51.34 | 55.44 | 46.37 | 52.66 | 57.39 |

By cracking the residue and also the pyrolysis fuel olefin, yields are increased significantly. For fixed amount of ethylene or olefin production, crude consumption is reduced. This is an advantage of cracking residue and pyrolysis fuel oil after hydroprocessing. In the industry, % C2+C3 shown in the table is denoted as ultimate yield.

In some of the above examples, a high severity cracking is used. Embodiments herein are not limited to high severity. A pyrolysis heater can be varied to meet a desired propylene to ethylene ratio. When a very high propylene ratio is required, olefin conversion technology may be used, such as by using the resulting butene and ethylene to produce propylene (metathesis, for example). Additional butene can be produced using an ethylene dimerization technology when butene produced in the pyrolysis is insufficient for olefin conversion. Therefore, if desired, 100% propylene with 0% ethylene can be produced. Using reverse olefin conversion technology, the propylene may be converted to ethylene and butene. Therefore, 100% ethylene and 100% propylene can be produced from crude integrating pyrolysis, a resid hydrocracker, olefin conversion technology, and/or dimerization technology.

As described above, embodiments herein may provide for flexibly processing whole crudes and other hydrocarbon mixtures containing high boiling coke precursors. Embodiments herein may advantageously reduce coking and fouling during the preheating, superheating, and the cracking process, even at high severity conditions. Embodiments herein may attain desirable yields, while significantly decreasing the capital and energy requirements associated with prefractionation and separate processing of the fractions in multiple heaters.

Suppression of coking throughout the cracking process and integration of pyrolysis and hydrocracking according to embodiments herein provides significant advantages, including increased olefin yield, increased run lengths (decreased down time) and the ability to handle feeds containing heavy hydrocarbons. Further, significant energy efficiencies may be gained over conventional processes including distillative separations and separate cracking reactors.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. An integrated pyrolysis and hydrocracking system for converting a hydrocarbon mixture to produce olefins, the system comprising:

a first mixing unit configured for mixing a whole crude and a gas oil to form a hydrocarbon mixture;

a heater configured for heating the hydrocarbon mixture and vaporizing a portion of hydrocarbons in the hydrocarbon mixture to form a heated hydrocarbon mixture;

a first separator configured for separating the heated hydrocarbon mixture into a first vapor fraction and a first liquid fraction at a vapor/liquid cut point in a range from 200° C. to 350° C.;

a second mixing unit configured for mixing steam with the first vapor fraction to form a steam-first vapor fraction mixture;

a heating coil in a convection zone of a pyrolysis reactor configured for superheating the steam-first vapor fraction mixture to form a superheated mixture;

a first radiant coil in a radiant zone of the pyrolysis reactor configured for receiving the superheated mixture and producing a thermally cracked effluent containing a mixture of olefins and paraffins;

a hydrocracking reactor system configured for contacting the first liquid fraction with a hydrocracking catalyst to crack a portion of hydrocarbons in the first liquid fraction, and recovering a hydrocracked effluent containing additional olefins and/or dienes from the hydrocracking reactor system;

a separator configured for separating unreacted hydrogen from hydrocarbons in the hydrocracked effluent;

a fractionator configured for fractionating the hydrocarbons in the hydrocracked effluent to form two or more hydrocarbon fractions, one of which is the gas oil; and a recycle line configured for recycling the gas oil to the first mixing unit.

2. The system of claim 1, further comprising a third mixing unit configured for mixing the first liquid fraction with steam to form a steam-first liquid fraction mixture, and a convection zone of the pyrolysis reactor configured for heating the steam-first liquid fraction mixture prior to the hydrocracking reactor system.

3. The system of claim 1, wherein the heater configured for heating the hydrocarbon mixture is disposed in the convection zone of the pyrolysis heater.

4. The system of claim 1, further comprising a feed line for providing steam to the first separator and/or a feed line for providing steam to the second separator.

5. A system for producing olefins and/or dienes, the system comprising:

a first vaporizer configured for partially vaporizing a whole crude to form a liquid fraction and a vapor fraction;

a first heater configured for superheating the vapor fraction and forming a superheated vapor fraction;

a hydrotreater configured for hydrotreating the liquid fraction, containing a catalyst for removing one or more of metals, sulfur, nitrogen, Conradson Carbon Residue (CCR), or asphaltenes, and producing a hydrotreated liquid;

a second vaporizer configured for partially vaporizing the hydrotreated liquid to form a second vapor fraction and a second liquid fraction;

a third vaporizer configured for partially vaporizing the second liquid fraction to form a third vapor fraction and a third liquid fraction;

a first hydrocracker configured for hydrocracking the third liquid fraction, converting hydrocarbon components therein having a boiling point greater than 550° C. to hydrocarbons having a boiling point of less than 550° C., and recovering a hydrocracked effluent;

a first separator configured for separating the hydrocracked effluent into a light hydrocracked fraction and a heavy hydrocracked fraction;

a second hydrocracker configured for hydrocracking the heavy hydrocracked fraction, converting hydrocarbon components therein to naphtha range hydrocarbons, and recovering a second hydrocracked effluent;

a second separator configured for separating the second hydrocracked effluent and recovering a second light hydrocracked fraction comprising the naphtha range hydrocarbons, and a second heavy hydrocracked fraction;

a fourth vaporizer configured for partially vaporizing the second heavy hydrocracked fraction to form a fourth vapor fraction and a fourth liquid fraction; and a thermal cracker configured for thermally cracking (i) the superheated vapor fraction, (ii) the second vapor fraction, (iii) the third vapor fraction, (iv) the second light hydrocracked fraction, (v) the fourth vapor fraction, and (vi) the fourth liquid fraction, and producing thermally cracked hydrocarbon effluents each containing a mixture of olefins and paraffins.

6. The system of claim 5, wherein one or more of the first vaporizer, the second vaporizer, the third vaporizer, and the fourth vaporizer are different sections of a single vaporizer.

7. The system of claim 5, wherein one or more of the first vaporizer, the second vaporizer, the third vaporizer, and the fourth vaporizer are located in one or more heating zones within a convection section of a pyrolysis reactor.

8. The system of claim 5, further comprising a third separator configured for separating the thermally cracked hydrocarbon effluents to recover one or more light olefins fractions and a fraction boiling above 370° C.

9. The system of claim 8, further comprising a feedline configured for feeding the fraction boiling above 370° C. to the first hydrocracker.

10. The system of claim 5, further comprising a first mixing unit configured for mixing the superheated vapor fraction, the second vapor fraction, and the second light hydrocracked fraction, the first mixing located upstream of the thermal cracker.

11. The system of claim 5, further comprising a second mixing unit configured for mixing the third vapor fraction and the fourth vapor fraction, the second mixing unit located upstream of the thermal cracker.

12. The system of claim 5, further comprising a feed line configured for feeding the light hydrocarbon fraction to the hydrotreater.

13. A system for producing olefins and/or dienes, the system comprising:

a first vaporizer configured for partially vaporizing a whole crude to form a liquid fraction and a vapor fraction;

a heater configured for superheating the vapor fraction to form a superheated vapor fraction;

a hydrotreater configured for hydrotreating the liquid fraction, removing one or more of metals, sulfur, nitrogen, Conradson Carbon Residue (CCR), or asphaltenes, and producing a hydrotreated liquid;

a second vaporizer configured for partially vaporizing the hydrotreated liquid to form a second vapor fraction and a second liquid fraction;

a third vaporizer configured for partially vaporizing the second liquid fraction to form a third vapor fraction and a third liquid fraction;

a first hydrocracker configured for hydrocracking the third liquid fraction, converting hydrocarbon components therein having a boiling point greater than 550° C. to hydrocarbons having a boiling point of less than 550° C., and recovering a hydrocracked effluent;

a first separator configured for separating the hydrocracked effluent to recover a light hydrocracked fraction and a heavy hydrocracked fraction;

a second hydrocracker configured for hydrocracking the heavy hydrocracked fraction, converting hydrocarbon components therein to naphtha range hydrocarbons, and recovering a second hydrocracked effluent;

a second separator configured for separating the second hydrocracked effluent to recover a second light hydrocracked fraction comprising the naphtha range hydrocarbons, and a second heavy hydrocracked fraction;

a thermal cracker configured for thermally cracking (i) the superheated vapor fraction, (ii) the second vapor fraction; (iii) the third vapor fraction, (iv) the second light hydrocracked fraction, and (v) the second heavy hydrocracked fraction, and producing thermally cracked hydrocarbon effluents each containing a mixture of olefins and paraffins.

14. The system of claim 13, wherein one or more of the first vaporizer, the second vaporizer, and the third vaporizer are different sections of a single vaporizer.

15. The system of claim 13, wherein one or more of the first vaporizer, the second vaporizer, and the third vaporizer are located in one or more heating zones within a convection section of a pyrolysis reactor.

16. The system of claim 13, further comprising a feedline for feeding the light hydrocracked fraction to the hydrotreater.

17. The system of claim 13, further comprising a third separator configured for separating the thermally cracked hydrocarbon effluents and recovering one or more light olefins fractions and a fraction boiling above 370° C.

18. The system of claim 17, further comprising a feedline configured for feeding the fraction boiling above 370° C. to the first hydrocracker.

19. The system of claim 13, further comprising a first mixing unit configured for mixing the superheated vapor fraction, the second vapor fraction, and the second light hydrocracked fraction, the first mixing located upstream of the thermal cracker.

20. The system of claim 13, further comprising a second mixing unit configured for mixing the third vapor fraction and the fourth vapor fraction, the second mixing unit located upstream of the thermal cracker.

21. The system of claim 13, further comprising a feed line configured for feeding the light hydrocarbon fraction to the hydrotreater.

* * * * *